US011286920B2

(12) United States Patent
Mollatt

(10) Patent No.: US 11,286,920 B2
(45) Date of Patent: Mar. 29, 2022

(54) METHOD, SYSTEM AND USE OF CONTROLLING WORKING RANGE OF A PUMP BELLOWS

(71) Applicant: RSM Imagineering AS, Trollasen (NO)

(72) Inventor: Torbjorn Mollatt, Trollasen (NO)

(73) Assignee: RSM Imagineering AS, Trollåsen (NO)

( * ) Notice: Subject to any disclaimer, the term of this patent is extended or adjusted under 35 U.S.C. 154(b) by 289 days.

(21) Appl. No.: 16/628,037

(22) PCT Filed: Jun. 27, 2018

(86) PCT No.: PCT/EP2018/067233
§ 371 (c)(1),
(2) Date: Jan. 2, 2020

(87) PCT Pub. No.: WO2019/007775
PCT Pub. Date: Jan. 10, 2019

(65) Prior Publication Data

US 2021/0140294 A1 May 13, 2021

(30) Foreign Application Priority Data

Jul. 4, 2017 (NO) ..... 20171101

(51) Int. Cl.
*F04B 43/00* (2006.01)
*F04B 49/06* (2006.01)
(Continued)

(52) U.S. Cl.
CPC ..... *F04B 43/0081* (2013.01); *E21B 43/26* (2013.01); *F04B 9/105* (2013.01);
(Continued)

(58) Field of Classification Search
CPC .... F04B 9/105; F04B 43/1136; F04B 43/067; F04B 43/0736; F04B 43/009;
(Continued)

(56) References Cited

U.S. PATENT DOCUMENTS 3,849,033 A 11/1974 Schall
4,381,180 A 4/1983 Sell
(Continued)

FOREIGN PATENT DOCUMENTS

EP 2913525 2/2015
EP 2913525 A1 * 9/2015 ..... F04B 45/02

*Primary Examiner* — Kenneth J Hansen
(74) *Attorney, Agent, or Firm* — Christian D. Abel

(57) ABSTRACT

Method, and associated system, computer program and use, of controlling working range of a pump bellows, including maximum limitations such as maximum retracting position and maximum extension position of the bellows, the method comprising the steps of: a) reading at least a first position of a bellows (6', 6") in a closed hydraulic loop volume using at least one position sensor (12', 12"), g) transmitting a first position signal representing the first position to a control system, h) wherein the control system, based on the at least first position signal: c1) determines the position of the bellows (6', 6") represented by the at least first position signal, c2) compares the position of the bellows (6', 6") with a predetermined bellows position operating range, and c3) if the position is outside the predetermined bellows position operating range, instructs an oil management system valve (16', 16") allowing a dual acting pressure boosting liquid partition device (2) to recalibrate the hydraulic fluid volume in the closed hydraulic loop volume to re-establish a hydraulic fluid volume that causes the at least first position to return to a position within the predetermined bellows position operating range.

12 Claims, 2 Drawing Sheets

(51) Int. Cl.

| | |
|---|---|
| ***F04B 49/10*** | (2006.01) |
| ***F04B 9/105*** | (2006.01) |
| ***F04B 45/02*** | (2006.01) |
| ***F04B 43/113*** | (2006.01) |
| ***F04B 49/02*** | (2006.01) |
| ***F04B 53/10*** | (2006.01) |
| ***E21B 43/26*** | (2006.01) |

(52) U.S. Cl.
CPC ..... *F04B 45/022* (2013.01); *F04B 49/065* (2013.01); *F04B 49/10* (2013.01); *F04B 43/1136* (2013.01); *F04B 49/02* (2013.01); *F04B 53/10* (2013.01); *F04B 2201/0201* (2013.01)

(58) Field of Classification Search
CPC .... F04B 43/0081; F04B 49/065; E21B 43/26; F15B 1/021; F15B 1/027
See application file for complete search history.

(56) References Cited

U.S. PATENT DOCUMENTS

| | | | | |
|---|---|---|---|---|
| 4,488,592 | A | 12/1984 | Mittal et al. | |
| 4,830,586 | A | 5/1989 | Herter | |
| 5,249,932 | A * | 10/1993 | Van Bork ..... | F04B 43/0081 417/386 |
| 5,308,230 | A | 5/1994 | Moore | |
| 6,364,460 | B1 | 4/2002 | Sager | |
| 2003/0004201 | A1 | 3/2003 | Traylor | |
| 2003/0042017 | A1 | 3/2003 | Traylor | |
| 2008/0014524 | A1 | 6/2008 | Kato et al. | |
| 2008/0145248 | A1 | 6/2008 | Kato et al. | |
| 2011/0189029 | A1* | 8/2011 | Van De Velde ..... | F04B 43/06 417/53 |
| 2014/0007957 | A1 | 3/2014 | Pabst | |
| 2014/0079573 | A1 | 3/2014 | Pabst | |

* cited by examiner

METHOD, SYSTEM AND USE OF CONTROLLING WORKING RANGE OF A PUMP BELLOWS

The invention relates to a method of controlling working range of a pump bellows and associated system and use, including maximum limitations such as maximum retracting position and maximum extension position of the bellows. The invention is particularly suitable for use in systems pumping high volumes of fluids with particles (slurry/sludge) at high pressures, such as pressures above 500 bars and up to 1500 bars or even higher.

The invention may form part of a larger pumping system comprising one or more of a pressure transfer device, a dual acting pressure boosting dual acting pressure boosting liquid partition device and a flow regulating assembly (such as a valve manifold).

The invention is suitable for use with high pressures, ranging from above 500 bars, and is especially suitable in hydraulic fracturing of oil/gas wells where difficult to pump fluids with particles such as proppants form part of the fluid. However, the pumping system may also find use in other well applications, such as in drilling operations for pumping drilling fluids and in cementing operations, plug and abandonment, completion or stimulation operations, acidizing or nitrogen circulation.

BACKGROUND OF THE INVENTION

Hydraulic fracturing (also fracking, fracing, fraccing, hydrofracturing or hydrofracking) is a well stimulation technique in which rock is fractured by a pressurized fluid, in the form of gel, foam, sand or water. Chemicals may be added to the water to increase the fluid flow or improve specific properties of the water, such treated water is called 'slickwater'. The process involves the high-pressure injection of 'fracking fluid' (liquid holding sand or other proppants and chemicals) into a wellbore to create cracks in the deep-rock formations through which natural gas, petroleum, and brine will flow more freely. Normally, mechanical piston pumps are used for pumping the fracking fluid under high pressures. These mechanical pumps have very limited operating time due to mechanical wear and tear on the sliding surfaces within the pump caused by the sand and particles in the pumped medium. Pumps operating with particle holding liquids and/or demanding chemical liquids under high pressure have sealing surfaces that the particles and/or abrasive chemical fluids (compounds) damage during operation. When the seals are damaged, there may be leaks and other problems resulting in the pump reduces its effectivity. In addition, the mechanical pumps operates at high speeds, that creates rapid pressure fluctuations through the whole unit (high number of cycles), which after time leads to breakdowns from fatigue. Consequently, the operating life cycle of such pumps are very limited and dependent on particle type, amount of particles, chemical composition and chemical concentration, as well as working pressure. In rotating pumps, the rotary (shaft) seals, and costly pump elements such as impellers and turbine wheels, are quickly worn. In piston pumps, the piston is worn against cylinder resulting in leaks, low efficiency and breakdown. Another well-known problem with plunger pumps is fatigue cracking of the fluid ends. The main cause of this is combined stresses from the pressure fluctuations and mechanical linear stress from the plungers. They are also limited by a maximum allowable rod load on the power end, making it necessary to match plunger size to desired rate/pressure delivery.

In general, plunger/piston pump units are utilized.

When a plurality of pumps are connected to the same flow line down to the well, and are online simultaneously, there is a risk that they form interference patterns that matches the reference frequency of the flow line down to the well. This lead to flow lines that moves around, that can lead to damage of the equipment and personnel (called "snaking" because the flow line moves like a snake).

In fracturing operations, when the pumps are turned off and hydraulic pressure is not longer applied to the well, small grains of hydraulic fracturing proppants hold the fractures open. The proppants are typically made of a solid material such as sand. The sand may be treated sand or synthetics or naturally occurring materials such as ceramics. In onshore fracturing, typically a so-called frack fleet comprising a number of trucks are transported and positioned at location. Each truck is provided with a pumping unit for pumping fracking fluid into the well. Thus, there are weight and physical limitations on the equipment to be used limited by the total weight capacities on the truck on the road and on the physical limitations given by the trucks.

Prior art, not suitable for fracturing but disclosing a system where clean hydraulic fluid is separated from the liquid to be pumped, includes EP 2913525 relating to a hydraulically driven diaphragm pumping machine ("pump"), in particular for water and difficult-to-pump materials. The system comprises at least two side-by-side pumping units. Each pumping unit comprises a pump cylinder and a hydraulic cylinder. The pump cylinder (reference signs relating to EP 2913525, 1,2) has a lower first end with a first inlet and outlet for liquid to be pumped and an upper second end with a second inlet and outlet for hydraulic fluid. The pump cylinder (1,2) contains a bellows (3,4) closed at its lower end and open at its upper end for communication with hydraulic fluid. The outside of the bellows (3,4) defines a space for liquid to be pumped. The bellows (3,4) of the pump cylinder (1,2) is arranged to be driven by hydraulic fluid supplied at its top end, in concertina like expansion and contraction to pump the liquid to be pumped adjacent the lower first end of the pump cylinder (1,2). The hydraulic cylinder (9,10) is placed side-by-side the pump cylinder (1,2). The hydraulic cylinder (9,10) has a lower first end associated with a hydraulic drive and an upper second end containing hydraulic fluid communicating with the upper second end of the pump cylinder (1,2). The hydraulic drive terminates at its upper end with a drive piston (19,20) slidably mounted in the hydraulic cylinder (9,10). The hydraulic drives of the hydraulic cylinders (9,10) of the two pumping units are connected by a hydro-mechanical connection (25,27) designed to advance and retract the pistons (19,20) of each hydraulic cylinder (9,10).

However, the solution in EP 2913525 is not applicable for hydraulic fracturing at high pressures (i.e. over 500 bars) because of the cylindrical pump chamber. The cylinder-shape of the pump chamber will not be able to withstand the high pressures experienced in combination with a high number of cycles when used in hydraulic fracturing. Furthermore, the bellows are polymer, resulting in risk of particles being squeezed between the cylindrical wall and the bellows, with the possibility of damage to the bellows. In addition, there is one hydraulic cylinder connected to each pump cylinder. The hydraulic cylinder is not configured to boost the pressures entering on the lower side of the piston (19, 20) because the effective area is smaller on the lower side of the piston (19, 20) than on the upper side of the piston (19, 20). Furthermore, on polymer bellows on lack the control on the direction of expansion leading to the possibility for the bellows to come in contact with the cylinder wall. This may lead to tearing and proppants being forced in to the base material.

Hydro-mechanical connections in general have some drawbacks, including:

can not synchronize with multiple units, can not vary ramp up/down depending on pressure and flow (can not offer of a precise control of the pump characteristics), can not partial stroke, can not compensate for pressure/flow fluctuations in the flow, it would never be able to overlap and make a laminar flow, it generates a pressure drop over the control valve, that leads to heating of the oil, and loss of efficiency in the range of 5-10%.

There is a problem with the conventional pumps utilized for fracking that the parts in the system can break down after a few hours and has to be repaired. Thus, to provide for redundancy in the system, frack fleets comprising a plurality of back-up pumps is normal. This drives cost both in maintenance and in man hours, as one service man can only operate a few trucks.

All hydraulic systems have a degree of internal leakage of hydraulic fluid, this will also occur in the closed loop hydraulic system over a number of cycles. This leakage will accumulate over a number of cycles, adding or retracting from the closed volume, leading to the bellows contracting or extending too much. Not having control on this, will lead to premature failure of the bellows.

Thus, an objective of the present invention is to solve at least some of the drawbacks in relation to the prior art solutions and more specific to keep moving parts (pistons, seals) away from particle fluid (i.e. pumped medium) and avoid particles damaging moving parts.

More specific, it is an objective of the present invention to provide a smooth and shock-free pumping of large flows at high pressures, reducing wear and tear on all components in the flow loop and at the same time providing a unit that is capable of seamlessly integrate and adapt to any pressure flow rate demand without the need for mechanical rebuild or changes. In addition, the present invention's ability to synchronize with multiple units, minimizes the risk of potential snaking. More specific, one of the objectives of the invention is to provide a system for fracking which can operate at high pressures with high volume flow.

Another objective is to provide a system where the liquid to be pumped is separated from as many moving parts as possible.

More specific, an objective is to minimize the risk of damaging the bellows.

Another objective is to provide a pumping system which has reduced weight, e.g. the pumping system shall be able to be arranged and transported on standard trucks or trailers forming part of so-called frack-fleets used in hydraulic fracturing.

Another objective is to provide a system not requiring an external guiding system for the bellows.

Another objective is to provide a fully stepless controlled bellow speed/stroke control to avoid pressure peaks, flow peaks and fluctuations.

Another objective is to create a pump system for all pressures and flow configurations, normally used in fracturing or other high pressure pumping industries, without the need of a mechanical rebuild.

Another objective of the invention is to provide an advanced control system and synchronization of multiple units, to eliminate the problems with conventional systems.

Another objective is to provide a solution which can be used in new installations and be connected to existing installations, such as retrofitting of existing systems.

SUMMARY OF THE INVENTION

The objectives are solved by the invention as set forth in the independent claims, where detailed embodiments of the invention are defined in the dependent claims.

The present invention provides a solution to the objectives by making sure that the amount of fluid in the closed hydraulic loop volume is always within predefined ranges, i.e. that it is not too much hydraulic fluid with the risk of unwanted extension of the bellows nor too little fluid with the risk of too much compression of the bellows. The invention can thus be a method of controlling working range of a pump bellows in a fracking system, and a fracking system.

Thus, the input to the control system is important for increasing the life-cycle of the components in the system, and in particular the moving components. For example, if there is a leakage of hydraulic fluid from the closed loop system, there is a risk that the bellows are damaged if it contracts/compresses too much.

The invention controlling the movement, constantly monitoring the position signal(s) from the dual acting pressure boosting liquid partition device and/or bellows. If necessary to adjust, the oil management system protocol (a part of the overall control system) with valve is used to correct the positions or to change oil. For example, if the system comprises a dual acting pressure boosting liquid partition device and a pressure cavity for pressurizing a first fluid (e.g. fracturing fluid) with a second fluid (e.g. hydraulic pump fluid) using a bellows for separating the first and second fluids, the bellows shall never be totally compressed nor maximum stretched or extended. If the bellows is repeatedly extended and compressed towards the maximum limits, the wear and tear, i.e. fatigue, is significantly increased, resulting in shorter life cycle.

The invention relates to a method of controlling working range of a pump bellows, including maximum limitations such as maximum retracting position and maximum extension position of the bellows, the method comprising the steps of:

a) reading at least a first position of a bellows in a closed hydraulic loop volume using at least one position sensor, b) transmitting a first position signal representing the first position to a control system, c) wherein the control system, based on the at least first position signal:

c1) determines the position of the bellows represented by the at least first position signal, c2) compares the position of the bellows with a predetermined bellows position operating range, and c3) if the position is outside the predetermined bellows position operating range, instructs an oil management system valve allowing a dual acting pressure boosting liquid partition device to recalibrate the hydraulic fluid volume in the closed hydraulic loop volume to re-establish a hydraulic fluid volume that causes the at least first position to return to a position within the predetermined bellows position operating range.

The predetermined bellows position operating range can be a predefined interval for the bellows position, which bellows position is continuously read or monitored by the control system, and the control system is then continuously monitoring the first position of the bellows and comparing with the predetermined position operating range.

The predetermined bellows position operating range can be defined by specific physical end positions for the bellows, both for compression and extension of the bellows. Alternatively, instead of physical end positions, the end positions can be software-operated positions indicating the end positions. A signal can then be transferred to the control system, indicating the bellows has reached end position(s). The physical or software-operated positions providing the end positions can be integral parts of the bellows, e.g. as part of a guiding system or a bellows position sensor, or separate from the bellows. The control system can then decide if the bellows has reached its end position. If the bellows does not reach end position, the control system can decide that an (expected) signal is not read, and instruct the oil management system valve to drain or refill hydraulic fluid in the closed hydraulic loop volume.

It is clear that all hydraulic systems have a degree of internal leakage of hydraulic fluid, however, throughout the description and claims the term closed loop hydraulic system has been used for such a "closed" system to distinguish from systems which are not defined by a definite volume.

The predetermined bellows position operating range can vary dependent on the size and/or amount of particles in the pumped fluid (e.g. fracking fluid).

The predetermined ranges will depend on the operating pressure, i.e. compressibility of the hydraulic fluid.

In an aspect, the method can be a method of controlling working range of a pump bellows in a fracking system.

In an aspect, the first position signal from the at least one position sensor represents the position of the bellows movably arranged within a pressure cavity.

In an aspect, a second signal from at least one position sensor represents the position of a plunger in a dual acting pressure boosting liquid partition device.

If the system is provided with at least two position sensors, and possibly additional sensors, redundancy is achieved. If using more than one sensor, redundancy for the control system is ensured in case one of the sensors malfunctions.

In an aspect, the control system compares the at least first position signal and the second signal and determines a difference in position between the bellows and the plunger and, compares the difference in position with a predetermined position difference range, and, if the difference in position is outside the predetermined position difference range, instructs an oil management system valve allowing a dual acting pressure boosting liquid partition device to recalibrate the hydraulic fluid volume in the closed hydraulic loop volume to re-establish a hydraulic fluid volume that causes the position difference to return to within the predetermined position difference range.

The predetermined position difference range depends and varies with different pressures. This is due to compressibility of the hydraulic liquid/fluid at different pressures. Furthermore, in this aspect, two different predetermined ranges are run simultaneously in the control system, i.e. the predetermined position difference range and the predetermined bellows position operating range, and the control system determines if the first position and the difference in position are within the given ranges.

If the bellow position is reaching the predetermined maximum deviation compared to the position of the plunger, the control system may send a signal to the oil management system valve to close a second valve port and open a third valve port to an oil reservoir. The dual acting pressure boosting liquid partition device will then adjust the piston according to last bellows position, after oil management system valve is closed (i.e. second valve port). After adjustment, the oil management system valve will open the first valve port and the second valve port and continue its duty cycle.

In an aspect, wherein, if the position is below the predetermined bellows position operating range or the position difference range, the control system instructs the oil management system valve allowing the dual acting pressure boosting liquid partition device to recalibrate to fill hydraulic fluid into the closed hydraulic loop volume, and if the calculated hydraulic fluid volume is higher than the predetermined bellows position operating range, the control system instructs the oil management system valve allowing the dual acting pressure boosting liquid partition device to recalibrate to drain hydraulic fluid from the closed hydraulic loop volume.

In an aspect, the at least first position is representing a volume in the closed hydraulic loop volume, and wherein the control system, before step c1), calculates a hydraulic fluid volume in the closed hydraulic loop volume to ensure exact bellows position, before continuing with step c1).

In an aspect, the method can further comprise:

d) before step c), reading a first temperature from one or more temperature sensors arranged at different locations in the closed hydraulic loop volume, e) transmitting a first temperature signal representing the first temperature to the control system, f) wherein the control system, based on the first temperature signal, determines the temperature in the closed hydraulic loop volume, compares the temperature with a predetermined temperature operating range, and based on whether the position, the difference in position or the temperature is within, above or below the predetermined bellows position operating range, the predetermined position difference range or predetermined temperature operating range, respectively, operates an oil management system valve allowing the dual acting pressure boosting liquid partition device to recalibrate by:

stay idle, fill hydraulic fluid into, or drain hydraulic fluid from the closed hydraulic loop system.

In an aspect, the bellows may have a center axis and the bellows may extend and retract in a substantially longitudinal direction along the center axis, and wherein one of the position sensors is a bellows position sensor reading the axial extension of the bellows.

In an aspect, the oil management system valve may be arranged between the dual acting pressure boosting liquid partition device and a pressure transfer device and comprises a valve arrangement, wherein the valve arrangement, based on input from the control system, is operated to:

open for fluid communication between the dual acting pressure boosting liquid partition device and the inner volume of the bellows, open for fluid communication between a fluid reservoir and the closed hydraulic loop volume for filling of hydraulic fluid into the closed hydraulic loop volume, open for fluid communication between a fluid reservoir and the closed hydraulic loop volume for draining hydraulic fluid from the closed hydraulic loop volume.

The invention further relates to a system comprising a control system communicating with an oil management system, the system comprises:

a pressure transfer device comprising:

a pressure chamber housing, the pressure chamber housing comprises:

a pressure cavity and a bellows movably arranged within the pressure cavity at least one position sensor configured to read the position of the bellows and transmit a first position signal representing the first position to the control system, and wherein the control system, based on the at least first position signal is configured to:

determine the position of the bellows represented by the at least first position signal, compare the position of the bellows with a predetermined bellows position operating range, and based on whether the position is outside the predetermined bellows position operating range, is configured to operate an oil management system valve allowing a dual acting pressure boosting liquid partition device to recalibrate the hydraulic fluid volume in the closed hydraulic loop volume to re-establish a hydraulic fluid volume that causes the at least first position to return to a position within the predetermined bellows position operating range.

In an aspect of the system, the first position signal from the at least one position sensor may represent the position of the bellows.

In an aspect of the system, a second signal from at least one position sensor may represent the position of a plunger in a dual acting pressure boosting liquid partition device.

In an aspect of the system, wherein the control system is configured to:

compare the at least first position signal and the second signal and determine a difference in position between the bellows and the plunger and, compare the difference in position with a predetermined position difference range, and if the difference in position is outside the predetermined position difference range, instruct an oil management system valve allowing the dual acting pressure boosting liquid partition device to recalibrate the hydraulic fluid volume in the closed hydraulic loop volume to re-establish a hydraulic fluid volume that causes the position difference to return to within the predetermined position difference range.

In an aspect, the system may further comprise one or more temperature sensors configured to read temperature in the closed hydraulic loop system and transmit signals to the control system, and wherein the control system is configured to:

based on whether the position, the difference in position or the temperature is within, above or below the predetermined bellows position operating range, the predetermined position difference range or predetermined temperature operating range, respectively, operate an oil management system valve allowing the dual acting pressure boosting liquid partition device to recalibrate by:

stay idle, fill hydraulic fluid into, or drain hydraulic fluid from the closed hydraulic loop system.

The invention further relates to a computer program, comprising processing instructions which, when executed by a processing device, cause the processing device to perform as set forth according to the method described above.

The invention further relates to use of the system described above in one of the following operations: hydrocarbon extraction or production, hydraulic fracturing operations, plug and abandonment, well drilling, completion or stimulation operations, cementing, acidizing or nitrogen circulation.

The invention further relates to use of the method or system described above for controlled acceleration and deceleration, respectively, of the pump bellows at a turning point of the plunger in the dual acting pressure boosting liquid partition device. This is advantageous in damping impact of check valves and to reduce vibrations in the system because the control system is able to monitor the position of the dual acting pressure boosting liquid partition device using the dual acting pressure boosting liquid partition device position sensor, and when approaching end position, the discharge speed of the unit is ramped down in order to cushion/dampening the speed of the valve element before entering the valve seat.

The working range, i.e. the operating range defined by the maximum limitations such as maximum retracting or compression position and the maximum extension position of the barrier, where an extension of 0% represents a fully collapsed or retracted position (i.e. first end position) and 100% refers to maximum extension position (i.e. second end position) of the barrier, is advantageously within: preferably 10% and 90%, more preferably within 20% and 80%, even more preferably within 30% and 70%. These exemplified ranges secures a significant increase in the life-cycle of the barrier.

The present invention provides significant improvements in relation to known solutions. The pumping system and associated components thereof, provides for the possibility of pumping at pressures up to 1500 bars and above with high volume flow. For example, the design provides for the possibility of pumping 1 m3 @1000 bar pressure per minute or, 2 m3 @500 bar per minute, and any rate to pressure ratio between. The invention provides for flexibility with regard to desired pump rates and pump pressures, e.g. reduced flow rates at high pressures and high flow rates at reduced pressures, in all embodiments with a substantially laminar flow.

A pumping system where the method and system in accordance with the present invention may be used, may comprise one or more of a pressure transfer device, a dual acting pressure boosting liquid partition device and a flow regulating assembly (such as a valve manifold). A hydraulic pump unit typically pressurizes the dual acting pressure boosting liquid partition device, wherein the dual acting pressure boosting liquid partition device pressurizes the pressure transfer device. The bellows in the pressure transfer device functions as a "piston" between the hydraulic pressure side, i.e. the dual acting pressure boosting liquid partition device and the hydraulic pump unit on one side, and the medium to be pumped into a well on the other side. The bellows functions as an extension of the piston in the dual acting pressure boosting liquid partition device. The bellows in the pressure transfer device separates the clean hydraulic fluid (inside the bellows) from the dirty fluid with particles (outside the bellows).

In all aspects of the invention the bellows shall be understood to be a fluid-tight barrier separating inner volume of the bellows and the volume between the outside of the bellows and the inside of the pressure cavity. I.e. the bellows has a fixed outer diameter but is axial flexible, providing an annular gap (size of gap e.g. at least corresponding to the particle diameter of particles in fracturing fluid) between the internal surface of the pressure chamber housing and the bellows in all positions of the bellows and at all pressures.

The bellows is preferably fixedly connected in the top of the pressure cavity, and the bellows is surrounded by the pressure cavity in all directions, i.e. below, radially and possibly partly on an upper side thereof of the parts not forming part of the connection port to hydraulic fluid entering and exiting the inner volume of the bellows. The total pressure cavity volume is constant whereas the inner volume of the bellows is changed. As the bellows extends and retracts inside the pressure cavity, the available remaining volume of the pressure cavity is changed. A hydraulic fluid volume enters the inside of the bellows and displaces the volume of the fluid to be pumped from the pressure cavity.

The pumping system may be a positive displacement pump where variations in volume in the pressure transfer device is achieved using a fluid-tight bellows which is radially rigid and axially flexible. This setup results in a bellows which moves substantially in the axial direction, whereas movements in the radial direction is prohibited or limited. When the bellows is in a first position, i.e. a compressed state, the remaining volume in the pressure cavity is largest, whereas when the bellows is in a second position, i.e. an extended state, the remaining volume in the pressure cavity is smallest. The ratio of dimensions of the inner surface of the pressure cavity and the outer surface of the bellows are designed such that there is formed a gap between the inner surface of the pressure cavity and the outer surface of the bellows in all positions of the bellows, thereby preventing particles being stuck between the inner surface of the pressure cavity and the bellows. Thus, the fracturing fluids surrounds the bellows and the gap is formed such that its minimum extension is larger than the largest particle size of the proppants. The radial rigidity of the bellows ensures that the bellows do not come into contact with the internal surface of the pressure chamber housing. Hydraulic fluid entering the inner volume of the bellows through the connection port pressurizes the barrier, and due to the rigid properties of the bellows and/or the possible internal guiding, all movement of the bellows is in the axial direction. The liquid to be pumped, e.g. fracking fluid, is pressurized by filling the inner volume of the bellows with hydraulic fluid thereby increasing the displaced volume of the bellows, which results in reduced remaining volume in the pressure cavity outside the bellows, and an increase in the pressure of the liquid to be pumped. The liquid to be pumped is then exiting through the first port and further out through a flow regulating assembly such as a valve manifold.

The pressure transfer device does not have any sliding surfaces in contact with the liquid to be pumped. Thus, the lifetime of the parts is prolonged because there are none vulnerable parts in sliding contact with any abrasive liquid to be pumped. The pressure transfer device is pressure compensated such that the driving hydraulic pressure is the same as the pressure in the liquid to be pumped, i.e. the fracturing fluid, and, as such, the bellows does not have to withstand the differential pressure between the inner hydraulic driving pressure and the pressure in the liquid to be pumped.

The pressure transfer device may be operated by pressure fed from a dual acting pressure boosting liquid partition device, which dual acting pressure boosting liquid partition device is pressurized by a hydraulic pump unit. The dual acting pressure boosting liquid partition device may be a dual acting pressure boosting dual acting pressure boosting liquid partition device. A first and/or second plunger chamber in the dual acting pressure boosting liquid partition device is part of at least one closed hydraulic loop volume with the inner volume of the bellows, and is capable of feeding and retracting large amount of hydraulic fluids under high pressures to the inner volume of the bellows.

The bellows may be returned to the first position, i.e. the compressed state, by assistance from feeding pressure in the liquid to be pumped. The liquid to be pumped, i.e. feed pressure from the feed pump pumping liquid to be pumped, provides pressure assisting in the compression of the bellows to the first position. In this compression phase, the pressure in the liquid to be pumped is equal to the pressure of the hydraulic fluid in the inner volume of the bellows, and the retracting will be a result of the dual acting pressure boosting liquid partition device creating a pressure differential in volume when retracting. When the dual acting pressure boosting liquid partition device retracts, there will be a differential volume that the pumped fluid volume, supplied and pressurized by the feed pump (blender) (i.e. the feed pump is supplying fracturing fluid to the pressure cavity), will compensate for by compressing the bellows. In the extension state, i.e. when the bellows starts extending by pressurized fluid filling the inner volume, the pressure in the hydraulic fluid is equal to the pressure in the liquid to be pumped (i.e. the feed pressure in inlet manifold and or the reservoir of liquid to be pumped). When the pressure in the pressure cavity exceeds the feed pressure a first valve close, and when the pressure exceeds the pressure in the discharge manifold, a second valve will open and the fluid will flow into the well. This compression and extension of the bellows will occur sequentially in the pressure transfer device.

The invention may be used together with a pump for pumping fluid with particles at pressures above 500 bars, the pressure transfer device comprising a pressure chamber housing and at least one connection port, the at least one connection port being connectable to a dual acting pressure boosting liquid partition device via fluid communication means, the pressure chamber housing comprises:

- a pressure cavity inside the pressure chamber housing, and at least a first port for inlet and/or outlet of fluid to the pressure cavity,
- a bellows defining an inner volume inside the pressure cavity, and wherein the inner volume is in fluid communication with the connection port, wherein the pressure cavity has a center axis with an axial length defined by the distance between the connection port and the first port and a varying cross sectional area over at least a part of the axial length, and wherein the bellows is configured to move in a direction substantially parallel with the center axis over a part of the axial length of the pressure cavity. The bellows is preferably radially rigid and axially flexible and is arranged to extend and retract over at least a portion of the pressure cavity length.

Thus, the pressure cavity has different transverse cross section, e.g. at least two different cross sections, in its longitudinal direction. Preferably, the transition areas between different transverse cross sections are smooth or continuous (without sharp edges). Such smooth or continuous transition areas prevent sedimentation and allows higher pressures without weak points in the pressure cavity. I.e. the forces applied to the pressure cavity comes as a result of the internal pressure. The geometry is optimized to make these forces as uniform as possible.

The connection port is thus adapted for suction of hydraulic fluid and/or expelling pressurized hydraulic fluid into and out of the pressure cavity.

The first port is adapted for inlet/outlet of liquid to be pumped into and discharged out of the pressure cavity.

According to an aspect, the bellows may be connected to an inner surface of the pressure cavity. Preferable, the bellows is connected in an upper part of the pressure cavity with means providing fluid-tight connection between the bellows and the inner surface of the pressure cavity. As such, fluids are prevented from flowing from an inner volume of the bellows and in to the pressure cavity.

The bellows has a shape adapted to the shape of the pressure cavity such that the bellows, in all operational positions thereof, is restricted from coming into contact with an internal surface of the pressure chamber housing. This means that the bellows, in all operational positions thereof, has a maximum extension in the axial and radial direction which is less than the restrictions defined by the inner surface of the pressure chamber housing.

In an aspect, the pressure cavity tapers towards the first port, thus creating a natural funnel where the sediments/proppants/sand may exit together with the fluid. Consequently, the first port of the pressure chamber housing is preferably shaped to prevent sedimentation build-up (proppants/sand etc.) by sloping the pressure cavity towards the first port. The first port may thus preferably be arranged in a lower section of the pressure cavity such that sediments may exit through the first port by means of gravity.

In an aspect, the pressure cavity can be elongated, egg-shaped, elliptical, circular, spherical, ball-shaped or oval, or has two parallel sides and at least a portion of smaller cross section than the cross section in the parallel portion.

In another aspect, the pressure cavity can be circular. In yet another aspect, the pressure cavity can be multi-bubbled (e.g. as the Michelin man).

In an aspect, the bellows has a smaller radial and axial extension than an inner surface of the pressure chamber housing (i.e. defining the radial and axial extension of the pressure cavity), thereby forming a gap between an outer circumference of the bellows and an inner circumference, i.e. the inner surface, of the pressure chamber housing in all operational positions of the bellows. Thus, at all pressures, fluid is surrounding at least two sides of the bellows during operation of the pressure transfer device.

According to an aspect, the bellows can have a cylindrical shape, accordium-like shape or concertina shape. The bellows cylinder construction provides minimal bellows loads since all its surface is constantly in a hydraulically balanced state. The bellows may thus comprise a concertina-like sidewall providing the axial flexibility and a fluid tight end cover connected to the sidewall of the bellows. The concertina-like sidewall may thus comprise a plurality of circular folds or convolutions provided in a neighboring relationship. Neighboring folds or convolutions may e.g. be welded together or connected to each other using other suitable fastenings means such as glue, mechanical connections. The neighboring folds or convolutions may be formed such that particles in the fracturing fluid are prohibited from being trapped between neighboring folds or convolutions in the bellows during retracting and extracting of the bellows. This may be achieved by making the operational range of the bellows, i.e. the predefined maximum extension and retraction of the bellows, such that the openings between neighboring folds or between the folds and the inner surface of the pressure cavity are always larger than the largest expected particle size. As such, the risk of trapped particles are minimized.

The bellows is preferably made of a sufficiently rigid material: metal, composite, hard plastic, ceramics, or combinations thereof etc. providing for a fluid-tight bellows, which is radially rigid and axially flexible. The bellows preferably moves substantially in the axial direction, whereas movements in the radial direction is prohibited or limited. The material of the bellows is chosen to withstand large pressure variations and chemicals in the fluid to be pumped, thus minimizing fatigue and risk of damage. If the bellows is made of metal, it can be used under higher temperatures than bellows which are made of more temperature sensitive materials (i.e. materials which can not operate under higher temperatures).

It is clear that other parts forming part of the overall system may also be made of appropriate materials dependent on the demands in the specific projects, such as metal (iron, steel, special steel or examples above). However, other materials may also be used, such as composite, hard plastic, ceramics, or alternatively combinations of metal, composite, hard plastic, ceramics.

In an aspect, the bellows may comprise a guiding system coinciding with, or being parallel to, a center axis of the pressure cavity, and wherein the bellows expands and retracts axially in a longitudinal direction along the center axis.

In an aspect, the guiding system may comprise a guide.

The pressure transfer device may further comprise a bellows position sensor monitoring position of the bellows and or a temperature sensor monitoring the temperature of a drive fluid in the closed hydraulic loop volume. In addition, pressure sensors may be used.

The bellows may comprise a guiding system which comprises a guide. The guide can be connected to a lower part of the bellows and may be configured to be guided in the pressure chamber housing. The guide in the pressure chamber housing can then form part of the inlet and outlet for hydraulic fluid into and out of the inner volume of the bellows. The guide may be coinciding with, or being parallel to, a center axis of the pressure cavity, and the bellows may expand and retract axially in a longitudinal direction along the center axis.

The bellows position sensor may be a linear position sensor. The bellows position sensor may be arranged in the connection port and comprise axial through-going openings for unrestricted flow of fluid.

In an aspect, when the bellows position sensor is a linear sensor, a reading device may be fixedly connected to the bellows position sensor and a magnet may be fixedly connected to the guide, and wherein the reading device may be an inductive sensor which can read the position of the magnet such that the bellows position sensor can monitor a relative position of the magnet inductively, and thereby the bellows.

In an aspect, the inductive sensor can be an inductive rod adapted to read the position of a magnet, and thereby the bellows.

In an aspect, the inductive sensor may comprise an inductive rod adapted to read the position of a magnet attached to the guide, in order for the bellows position sensor to monitor the relative position of the magnet inductively, and thereby the bellows.

The pressure transfer device may further comprise an additional fluid tight barrier inside the bellows. This may be used in order to further reduce or minimize the risk of fluids leaking between the inner volume of the bellows and the pressure cavity comprising liquid to be pumped. This additional fluid tight barrier may be a bladder, a bellows, a non-permeable layer of a material, and may have the same or different shape as the bellows.

In an aspect, the pressure transfer device may further comprise an external barrier between the bellows and an internal surface of the pressure chamber housing. This external barrier may be particle protective (strainer) or fluid tight, and may be a pliable material, a similar bellows as the bellows in place, a strainer etc.

The control system also enables partial stroking when working with large proppants, and/or at start-up. This is crucial in situations where the unit has had an unplanned shut down where pumped liquid still is a slurry, allowing proppants to fall out of suspension and sediment. Partial stroking is then applied in order to re-suspend the proppants in to a slurry (suspended).

In an aspect, the system may comprise two pressure transfer devices and the dual acting pressure boosting liquid partition device can be configured to sequentially pressurize and actuate the two pressure transfer devices, such that one pressure transfer device is pressurized and discharged (fracturing fluid discharged) while the other is de-pressurized and charged (charged by new fracturing fluid), and vice versa. The depressurizing and charging operation may be aided by the feed pump. Two dual acting pressure boosting liquid partition devices can be configured to be operated individually, such that they can pressurize two of the pressure transfer devices simultaneously, i.e. synchronously, or asynchronously, i.e. overlapping.

In another aspect, the system may comprise four pressure transfer devices and two dual acting pressure boosting liquid partition devices, each of the dual acting pressure boosting liquid partition devices being configured to sequentially pressurize and discharge two pressure transfer devices, such that two of the pressure transfer devices are pressurized and thereby discharged while the other two pressure transfer devices are de-pressurized and thereby charged, and vice versa. It is further possible to provide a truck comprising the pressure transfer device as defined above and/or the system defined above used in hydraulic fracturing.

The system may further comprise a bellows position sensor adapted to monitor an axial extension of the bellows and thus an amount of fluid entering and exiting the inner volume of the bellows, as well as a dual acting pressure boosting liquid partition device position sensor monitoring the position of the dual acting pressure boosting liquid partition device, wherein the signals from the bellows position sensor and the dual acting pressure boosting liquid partition device position sensor is monitored by the control system, and compared with predefined working ranges for the extension of bellows and position of the dual acting pressure boosting liquid partition device. This is done because it is advantageous to know, and to be able to control, the position of the axial extension of the bellows (the bellows shall never be totally compressed nor maximum stretched). Thus, the input to the control system is important. For example, if there is a leakage of hydraulic fluid from the closed hydraulic loop system, there is a risk that the bellows are damaged if it contracts/compresses too much (i.e. outside of the predefined operating range). Too much of contraction may lead to proppants or sand being trapped in between neighboring folds or convolutions in the bellows and/or build-up of delta pressure, whereas too much extension may lead to e.g. increased fatigue of the bellows or potential collision with the lower surface of the pressure chamber housing, reducing the expected lifespan of the bellows.

The volume flowing into and out of the inner volume of the bellows is monitored using the bellows position sensor providing a high accuracy and a controlled acceleration/deceleration of the bellows at the turning point of the dual acting pressure boosting liquid partition device, which again results in calm and soft seating of the valves, i.e. 'ramped down' movement of the valves in the flow regulating system. The slow and controlled movement of the valves prevents or minimize the risk of damaging the valve seats in the flow regulating system. Thus, to achieve this, the system is able to monitor the position of the dual acting pressure boosting liquid partition device using the dual acting pressure boosting liquid partition device position sensor, and when approaching end position, the discharge speed of the unit is ramped down in order to cushion/dampening the speed of the valve element before entering the valve seat.

The dual acting pressure boosting liquid partition device that gives the control of the volume to be discharged in and out of the bellows, and also working as a pressure amplification or booster device, is preferably a double/dual-acting pressure boosting hydraulic cylinder/plunger pump where the hydraulic pump pressure entering the pump is pushing/pressing on an area with a fixed ratio larger than the secondary area. The secondary area is the area working on the fluid entering and exiting the inner volume of the bellows. This setup provides for a double, triple or even quadruple (or more) working pressure on the secondary area. The hydraulic pump system driving the dual acting pressure boosting liquid partition device, having a pressure range of e.g. 350 bars, can for example deliver 700-1400 bars to the inner volume of the bellows, and thus the same pressure in the pressure cavity. In order to be able to obtain a pressure transfer device and dual acting pressure boosting liquid partition device to function and operate satisfactory under the above specified high pressures, the system is preferably able to control and position the bellows with high accuracy. The closed hydraulic loop volume (e.g. oil volume) operating the bellows is preferably configured to be adjusted in volume by the oil management system valve to make sure the bellows is operating within predefined working ranges/region of operation and the hydraulic fluid in the closed hydraulic loop volume has to be monitored continuously in relation to temperature and replaced with cooled (fresh) fluid when required, all possible during/under/while pumping, although at a reduced rate for the overall system. The dual acting pressure boosting liquid partition device is preferably double acting where a primary side, defined by a first piston area, of the dual acting pressure boosting liquid partition device operates with a pressure difference of 350-400 bars, and on the secondary side, defined by a second piston area, can have a multiple pressure, for example 1050 bars or higher, which will be similar to the pressure that the pressure transfer device, i.e. the bellows and pressure cavity can operate under.

The pressure transfer device can be operated by the hydraulic pump unit, e.g. an over center variable pump which controls the dual acting pressure boosting liquid partition device. The hydraulic pump unit may have two directions of flow and an adjustable displacement volume. The hydraulic pumping unit may be driven e.g. by any motor operable to operate such hydraulic pump units, such as diesel engines or other known motors/engines. However, it is clear that the described hydraulic pump unit can be exchanged with a variety of hydraulic pumps controlled by a proportional control valve for pressurizing the dual acting pressure boosting liquid partition device and pressure cavity.

The pressure transfer device is preferably pressure compensated, meaning that the bellows is hydraulically operated by guiding an amount of oil or other hydraulic liquid into and out of the inner volume of the bellows moving the bellows between a first position, i.e. compressed state, and a second position, i.e. extended state. In operation, there will be the same pressure in the hydraulic fluids in the inner volume of the bellows as in the fracturing fluid (i.e. medium to be pumped) in the pressure cavity outside of the bellows. The liquid or medium to be pumped, e.g. fracturing fluid, being arranged below the bellows and in the gap formed between the outside of the bellows and the inner surface of the pressure chamber housing.

The pressure transfer device nor the dual acting pressure boosting liquid partition device do not have any sliding surfaces in contact with the liquid to be pumped. Thus, the lifetime of the parts is prolonged because there are none vulnerable parts in sliding contact with any abrasive liquid to be pumped. The system may be controlled by an electromechanical control system. The inputs to the pump control may include one or more of the following:

- pressure sensors in low pressure hydraulics (clean oil) and slurry/sludge feed line
- position sensors in dual acting pressure boosting liquid partition device including piston/plunger and bellows position
- temperature sensors in closed hydraulic loop volume and low pressure hydraulics
- HMI (Human Machine Interface) inputs setting desired flow, power, volume, delivery characteristics
- well data (pressure, flow, pulsation characteristics)
- filter, oil-level The pressure transfer device (via the dual acting pressure boosting liquid partition device) is controlled by giving the hydraulic pump units, e.g. over-center axial piston pumps, variable instructions based on the inputs.

It is further possible to provide a trailer, container or a skid, comprising the system defined above used in hydraulic fracturing together with an engine and necessary garniture.

The invention further relates to a fleet comprising at least two trailers, each trailer comprising at least one system as described above.

Summarized, the invention and the control system which may be in connection with an electromechanical control system may have benefits compared to the prior art solutions, including:

- Variable pressure, power and flow; as the conditions of a pumping task may vary, the system is able to adapt to the specific conditions. E.g. if the pressure increases, the system is able to automatically adjust the flow to the maximum allowable power out-put. If there is a set pressure, the electromechanical control system is able to vary the flow to maintain this pressure. If there is a set flow, the electromechanical control system is able to vary the pressure and power up to the system limitations. It is also possible to combine the control parameters.
- Partial stroking; when a system is taken off-line without flushing out the sludge/slurry before-hand, sedimentation will occur. In order to avoid clogging, the system is able to "re-excite" the pumped media through pulsation.
- Variable ramping; the ideal ramping function for the system changes as a function of the pressure and flow.
- Soft on-line/off-line; system able to gradually increase flow in order to prevent pressure peeks as a the pumping system goes on-line/off-line.
- Synchronization of multiple units; a "frack-spread" co of multiple units pumping simultaneously. This leads to situations where the pressure-fluctuations in the system sometimes matches the harmonic oscillation frequency of the pipeline causing damage and potentially hazardous situations (snaking described above). By synchronizing the units and thereby controlling the output oscillation frequency this problem is eliminated. This also enables individual units to increase or decrease delivery rates depending on system heat limitations without changing the over-all system performance.
- Overlapping the pressure transfer devices to achieve a steady laminar flow of the pumped medium (e.g. the fracking fluid) down to the well. For example, if each system comprises four pressure transfer devices coupled in pairs with two dual acting pressure boosting liquid partition devices. This enables an asynchronous drive system that can deliver a virtually pulsation free flow (laminar flow).
- Pulsation dampening; in the event of running a hybrid "frack spread" with the combination of conventional pumping systems and the pressure transfer device and systems according to the present invention, it is possible to counter-act the pulsations generated from the conventional pumping systems by pulsating the pressure transfer device and systems according to the present invention in opposite phase.
- No minimum rate; the hydraulic pump units, e.g. over-center axial piston pump, functions as an IVT (infinite variable drive) and can thereby seamlessly vary delivery-rates from zero to max.
- The Electromechanical control system provides the possibility to directly drive the dual acting pressure booster liquid device from hydraulic pump unit, e.g. the over-center axial piston pump. This leads to faster response time and less pressure drop in the overall system, increasing efficiency and decreasing heat generated in the system.
- Full control over the bellows extension and retraction through the whole movement is achieved. This give the possibility to detect failure, internal leakages, and avoids damaging the bellows by not running it outside the specified operating parameters.

Throughout the description and claims different wordings has been used for the liquid to be pumped. The term shall be understood as the liquid in the pressure cavity on the outside of the bellows, e.g. the hydraulic fracking fluid, fracturing fluid, fraccing, hydrofracturing or hydrofracking, or mud, stimulation fluid, acid, cement etc.

Furthermore, various terms have been used for the position of the dual acting pressure boosting liquid partition device or the position of the rod or piston in the dual acting pressure boosting liquid partition device. This shall be understood as the position of the rod or piston relative the outer shell of the dual acting pressure boosting liquid partition device.

These and other characteristics of the invention will be clear from the following description of a preferential form of embodiment, given as a non-restrictive example, with reference to the attached drawings wherein;

DETAILED DESCRIPTION OF A PREFERRED EMBODIMENT

Figure 1:
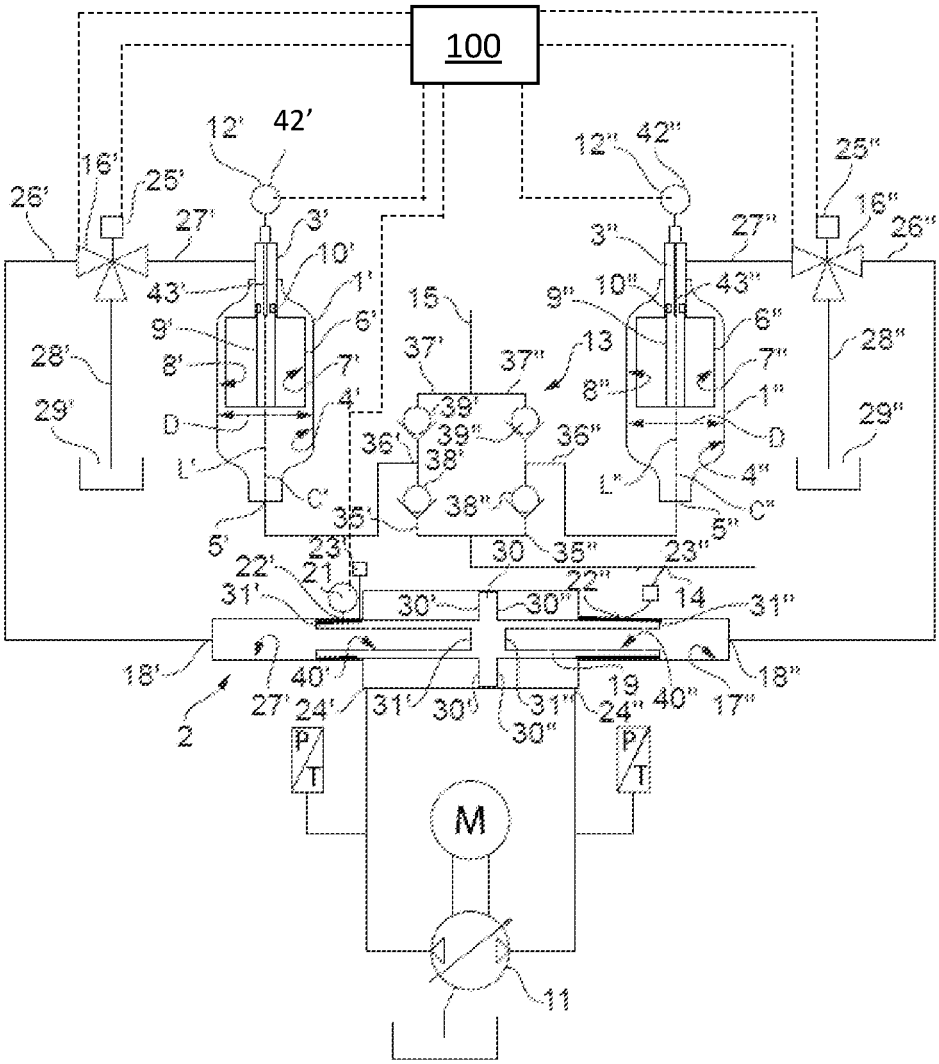
FIG. 1 shows an example of a preferable operational setup for the method and system in accordance with the present invention.

FIG. 1 shows an example of a preferable operational setup for the method and system in accordance with the present invention. It is disclosed a well stimulation pressure transfer device specifically designed for very high pressure (500 bar and above) at high rates (e.g. 1000 liters/min or more for the specific system disclosed in FIG. 1) pumping fluids, such as slurries, containing high amounts of abrasive particles. Two identical setups are disclosed in FIG. 1, having a common dual acting pressure boosting dual acting pressure boosting liquid partition device 2, where the elements of the setup on the left side is denoted with a single apostrophe (') and the elements in the identical setup on the right side is denoted with double apostrophe (").

Figure 2:
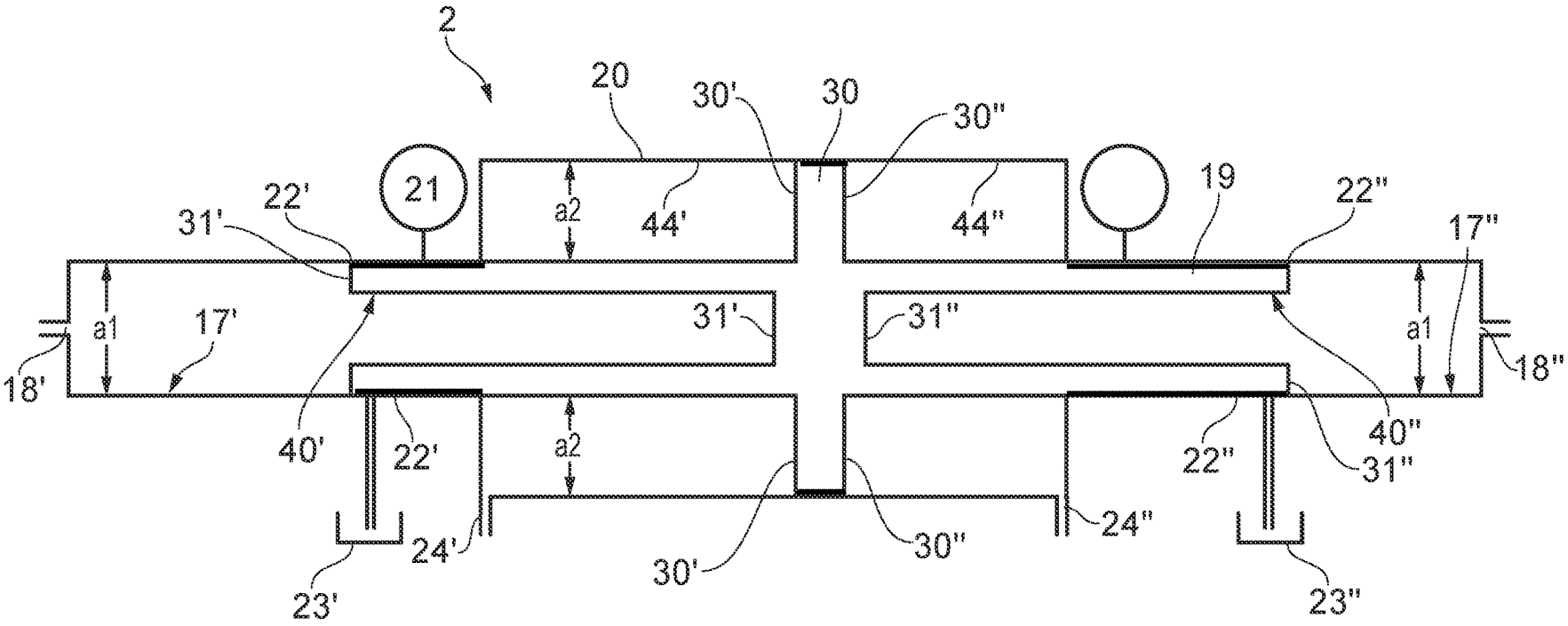
FIG. 2 shows details of a dual acting pressure boosting liquid partition device which can be used in connection with at least one pressure transfer device.

Details of the dual acting pressure boosting liquid partition device 2 used in connection with the pressure transfer device 1', 1" is shown in FIG. 2. It is shown a pressure transfer device 1', 1" for pumping fluid at pressures above 500 bars, the pressure transfer device 1', 1" comprising a pressure chamber housing and a connection port 3', 3", the connection port 3', 3" being connectable to a dual acting pressure boosting liquid partition device 2 via fluid communication means in the form of first valve port 26', 26" and second valve port 27', 27" and possibly via an oil management system valve 16', 16". The pressure chamber housing comprises a pressure cavity 4', 4", and a first port 5', 5" connecting the pressure cavity 4', 4" to a well via a flow management system 13. The first port 5', 5" acting as inlet and/or outlet for fluid or liquid to be pumped. It is further disclosed a bellows 6', 6" arranged within the pressure cavity 4', 4", and wherein an inner volume 7', 7" of the bellows 6', 6" is in fluid communication with the connection port 3', 3" and the inner volume 7', 7" is prevented from fluid communicating with the pressure cavity 4', 4". The pressure cavity length L', L", extending in a longitudinal direction between the connection port 3', 3" and the first port 5', 5", has a varying cross sectional area. The bellows 6', 6" is configured to move in a direction substantially in the longitudinal direction, which in the drawing is coinciding with the center axis C', C" of the pressure cavity 1', 1".

The pressure transfer device 1', 1" comprises a bellows, exemplified as a hydraulically driven fluid-tight bellows 6', 6" comprising an internal guide 9', 9" and a bellows position sensor 12', 12"with an inductive rod 43', 43" adapted to read a magnet 10', 10". The magnet 10', 10" may be fixedly connected to the guide 9', 9". The guide 9', 9" is itself guided in the pressure chamber housing, for example along the longitudinal extension of the connection port 3', 3". In the disclosed example, the guide 9', 9" is connected to the lower end of the bellows 6', 6" in one end and is guided in the pressure chamber housing in the upper end thereof. The guide 9', 9", and thereby the magnet 10', 10", follows the movement of the bellows 6', 6". The bellows position sensor 12', 12", e.g. the measuring rod 43', 43" may comprise means for detecting and determining the position of the magnet 10', 10" (and thereby the guide 9', 9" and bellows 6', 6"), for example by inductive detection of the magnet position. Although the description describes that the magnet 10', 10" is connected to the guide 9', 9" which moves relative to the fixed measuring rod 43', 43', it is possible to arrange the magnet 10', 10" stationary and e.g. the guide 9', 9" inductive to monitor the position. Furthermore, it is possible to use other sensors than the linear position sensor described above as long as they are capable of monitor the exact position of the bellows 6', 6".

The bellows 6', 6" is placed in a pressure cavity 4', 4" with a defined clearance to the internal surface of the pressure chamber housing'. The drive fluid is directed into and out of an inner volume 7', 7" of the bellows 6', 6" through a connection port 3', 3" in the top of the pressure cavity 4', 4" (i.e. the top of pressure chamber housing). The bellows 6', 6" is fixedly connected in the top of the pressure cavity 4', 4" to the internal surface of the pressure chamber housing by means known to the skilled person. The connection port 3', 3" is in communication with a dual acting pressure boosting liquid partition device 2 and possibly an oil management system valve 16', 16'.

The pressure transfer device 1', 1" may further comprise an air vent (not shown) to ventilate air from the fluid to be pumped. The air vent may be any vent operable to draw out or ventilate excess air from a closed system, such as any appropriate valves (choke) or similar.

The pumped medium, e.g. fracking fluid with particles, enters and exits the pressure cavity 4', 4" through a first port 5', 5" in the bottom of the pressure cavity 4', 4" (i.e. pressure chamber housing). The first port 5', 5" is in communication with a flow regulating device 13, such as a valve-manifold. The flow regulating device 13 is explained in greater detail below.

Driven by the dual acting pressure boosting liquid partition device 2 the pressure cavity 4', 4", in combination with the bellows 6', 6", is pumping the fluid by retracting and expanding the bellows 6', 6" between its minimum and maximum predefined limitation. Keeping the bellows within this minimum and maximum predefined limitation prolongs the life of the bellows. In order to ensure that the bellows 6', 6" work within its predefined limitation, this movement is monitored by the bellows position sensor 12', 12". Dynamically moving the bellows outside these minimum and maximum predefined limitations, may severely reduce the life time of the bellows. Without this control, the bellows 6', 6" will over time, as a result of internal leakage mainly in the dual acting pressure boosting liquid partition device 2, be over-stressed either by over-extending (will eventually crash with pressure cavity 4', 4" or over compress (retract) causing particles in fluid to deform or puncture the bellows 6', 6" or generate delta pressure). A central guiding system 9', 9", exemplified as a guide 9', 9", ensures that the bellows 6', 6" retract and expand in a linear manner ensuring that the bellows 6', 6" do not hit the sidewalls of the pressure cavity 4', 4" and at the same time ensures accurate positioning readings from the bellows position sensor 12', 12". Thus, the pressure cavity 4', 4" is specifically designed to endure high pressures and cyclic loads at the same time as preventing build-up of sedimentation. The defined distance between the outer part of the bellows 6', 6" and the internal dimension of the pressure chamber housing ensures pressure balance of the internal pressure of the bellows 6', 6" and the pump medium pressure in the pressure cavity 4', 4".

This pressure cavity is designed to carry the cyclic loads that this system will be subjected to, and to house the bellows and the bellows positioning system. The connection port 3', 3" has a machined and honed cylindrical shape through the base material of the pressure cavity 4', 4" "body" and serves as a part of the bellow guiding system 9', 9" like a cylinder and piston configuration. The pressure cavity 4', 4" is ideally shaped to prevent stress concentrations. The internal bellows guiding system 9', 9" ensures a linear movement of the bellows 6', 6" without the need of an external guide.

The first port 5', 5" of the bottom in the pressure cavity 4', 4", is shaped to prevent sedimentation build-up by sloping or tapering the pressure cavity 4', 4" towards the first port 5', 5". Consequently, sedimentation build-up is prevented because the sediments or particles in the liquid to be pumped naturally flows, i.e. by aid of gravity, out of the pressure cavity 4', 4" exiting through the first port 5', 5". Without this sloped or tapered shape, the sedimentation build up may lead to problems during start-up of the pressure transfer device and or the sediments may build-up and eventually surround lower parts of the outside of the bellows 6', 6".

The dual acting pressure boosting liquid partition device 2 comprises a hollow cylinder housing 20 having a longitudinal extension, wherein the hollow cylinder housing 20 comprises a first and second part having a first transverse cross sectional area a1 and a third part having a second transverse cross sectional area a2 of different size than the first and second part. The dual acting pressure boosting liquid partition device comprises a rod movably arranged like a piston inside the cylinder. The rod has a cross sectional area corresponding to the first transverse cross sectional area a1 and defines a second piston area 31', 31", and wherein the rod, when arranged within the hollow cylinder, defines a first plunger chamber 17' and a second plunger chamber 17" in the first and second part. The rod further comprises a protruding portion 30 having a cross sectional area corresponding to the second transverse cross sectional area a2 and the protruding portion defining a first piston area 30', 30" and a first outer chamber 44' and a second outer chamber 44" in the third part. A part of the rod defining the first and second plunger chamber 17', 17", over at least a part of its length, is formed with a first recess 40' in pressure communication with the first plunger chamber 17' and a second recess 40" in pressure communication with the second plunger chamber 17".

The first plunger chamber 17' comprises a first plunger port 18' that is in communication with the inner volume 7' of the bellows 6', alternatively via the first oil management system valve 16'. Similarly, the second plunger chamber 17" comprises a second plunger port 18" that is in communication with the inner volume 7" of the bellows 6", alternative via the second oil management system valve 16". The volumes inside the first and second plunger chambers 17', 17" are varied with the rod 19 being extracted and retracted in/out of the respective first and second plunger chamber 17', 17". The rod 19 may comprise a dual acting pressure boosting liquid partition device position sensor 21. First and second seals 22', 22" may be arranged between the protruding portion 30 of the rod and the first plunger chamber 17' and the second plunger chamber 17", respectively. Said first and second seals 22', 22" may be ventilated and cooled by a separate or common lubrication system 23', 23".

The rod 19 is driven back and forth by allowing in sequence pressurized fluid, such as oil or other suitable hydraulic fluid, to flow in to first inlet/outlet port 24' and out of second inlet/outlet port 24", then to be reversed to go in the opposite direction. First and second inlet outlet ports 24', 24" are in communication with a hydraulic pump unit 11.

The first and second oil management system valves 16', 16" are positioned between the bellows 6', 6" and the dual acting pressure boosting liquid partition device 2 and are exemplified as two three-way valves which may comprise a first and second actuators 25', 25" operating the first and second three-way valves, respectively. The setups of the first and second oil management system valves 16', 16" and their connection to the different pressure transfer devices 1', 1", are identical. Thus, in the following the system on the left hand side, i.e. the system in communication with the first plunger port 18', will be described in more detail. The oil management system valve 16', in the drawings exemplified as a three-way valve, comprises three ports including a first valve port 26' in communication with first plunger port 18', a second valve port 27' in communication with the connection port 3' of the pressure transfer device, and a third valve port 28' in communication with an oil reservoir 29'. Similarly, with reference to the pressure transfer device 1" on the right hand side, the oil management system valve 16" in communication with the second plunger port 18", comprises three ports including first valve port 26" in communication with second plunger port 18", a second valve port 27" in communication with the connection port 3" of the pressure transfer device 1", and a third valve port 28" in communication with an oil reservoir 29".

The hydraulic pump unit 11 may comprise over center axial piston pumps that are controlled by the position data from both bellows position sensor 12', 12" and dual acting pressure boosting liquid partition device position sensor 21 in the dual acting pressure boosting liquid partition device 2 and possibly according to input data from Human Machine Interface (HMI) and/or the control system 100. The hydraulic pumping unit 11 may be driven e.g. by a motor M such as any standard motors used in the specific technical fields.

The flow regulating assembly 13, e.g. a valve manifold, may be a common flow regulating assembly for the identical systems on the left hand side and on the right hand side of the Figure. In relation to the system on the left hand side, the flow regulating assembly 13 may comprise a pump port 36' in communication with the first port 5' of the pressure transfer device 1', a supply port 35' in communication with the liquid to be pumped via an inlet manifold 14 in the flow regulating assembly 13, and a discharge port 37' in communication with discharge manifold 15 in the flow regulating assembly 13. To be able to switch and operate between the different inlets and outlets, the flow regulating assembly may comprise supply valve 38' comprising a check valve allowing supply of pump fluid when the pressure in the inlet manifold 14 is larger than the pressure in the pressure cavity 4' and less than the pressure in the discharge valve 39'. The inlet manifold 14 is in communication with a feed pump and blender. The blender mixes the liquid to be pumped, and the feed pump pressurizes the inlet manifold 14 and distributes said mixed fluid to the pressure transfer devices 1', 1" (pressure cavities 4', 4"). The blender typically mixes the liquid to be pumped with particles such as sand and proppants. Such feed pump and blender are known for the person skilled in the art and will not be described in further detail herein.

Similarly, for the system on the right hand side of the Figure, the flow regulating assembly 13 may comprise a pump port 36" in communication with the first port 5" of the pressure transfer device 1", a supply port 35" in communication with the liquid to be pumped via an inlet manifold 14, and a discharge port 37" in communication with discharge manifold 15. Furthermore, to be able to switch and operate between the different inlets and outlets, the flow regulating assembly may comprise supply valve 38" comprising a check valve allowing supply of pump fluid when the pressure in the inlet manifold 14 is larger than the pressure in the pressure cavity 4", and discharge valve 39" allowing fluid to be discharged to the discharge manifold 15 when the pressure in the pressure cavity 4" is higher than the pressure in the discharge manifold 15 for pumping fluids at high pressures and flow rates e.g. into a well.

The flow regulating assembly 13 distributes the pumped liquid between the inlet manifold 14, the pressure cavity 4', 4" and the outlet manifold 15 by utilizing two check valves, one for inlet and one for outlet, and charge/discharge port positioned between them. The supply valve 38', 38" positioned between the supply port 35', 35" and the pump port 36', 36' allowing fluid to charge the pressure cavity 4', 4" when bellows 6', 6" is retracting, i.e. the liquid to be pumped provides pressure from below assisting in the retraction/compression of the bellows 6', 6". The assisting pressure of the liquid to the pressure transfer device in the inlet manifold 14 is typically in the range 3-10 bars refilling the pressure cavity 4', 4" and preparing for next dosage of high pressure medium to be pumped down into the well. When bellows 6', 6" starts extending (i.e. pressurized fluid is filling the inner volume 7', 7" of the bellows 6', 6") the supply valve 38', 38" will close when the pressure exceeds the feed pressure in the inlet manifold 14 and thereby force the discharge valve 39', 39" to open and thereby discharging the content in pressure cavity 4', 4" through the discharge port 37', 37" and in to the discharge manifold 15. This will occur sequentially in the setup on the left hand side of the Figure and on the right hand side of the Figure, respectively.

The hydraulic pump unit 11 utilizes over center axial piston pumps configured in an industrially defined closed hydraulic loop volume, also named swash plate pumps. Swashplate pumps have a rotating cylinder array containing pistons. The pistons are connected to the swash plate via a ball joint and is pushed against the stationary swash plate, which sits at an angle to the cylinder. The pistons suck in fluid during half a revolution and push fluid out during the other half. The greater the slant the further the pump pistons move and the more fluid they transfer. These pumps have a variable displacement and can shift between pressurizing first inlet/outlet port 24' and second inlet/outlet port 24" thereby directly controlling the dual acting pressure boosting liquid partition device(s) 2.

The oil management system valve 16', 16" is exemplified as a three-way valve. However, other setups may be used such as an arrangement of two or more valves. The oil management system valve is controlled by a control system 100 which can determine if correct volume of hydraulic fluid is circulated between the inner volume 7', 7" of the bellows 6', 6" and the first and second plunger chambers 17', 17" by utilizing the position sensors in the bellows and in the dual acting pressure boosting liquid partition device. At the same time, it enables the system to replace the oil in this closed hydraulic loop volume if temperatures in the oil reaches operational limits. This is done by isolating the second valve port 27', 27"from the dual acting pressure boosting liquid partition device and opening communication between first valve port 26', 26" and third valve port 28', 28", thereby allowing the piston 30 or rod 19 in the dual acting pressure boosting liquid partition device 2 to position itself according to the bellows 6', 6" position. The control system 100 controlling the oil management system valve 16', 16" monitors the position of the bellows 6', 6" in co-relation with the position of the plunger 19 and adds or retract oil from the system when the system reaches a maximum deviation limit. It will do this by, preferably automatically, stopping the bellows 6', 6" in a certain position and let the plunger 19 reset to a "bellows position" accordingly. A bellows position of the plunger 19 is typically corresponding to a position where the volumes of the first plunger chamber 17' and the second plunger chamber 17" are the same, which in most situations will be a position where the bellows6', 6" is in a mid position. Thus, the plunger 19 is preferably positioned relative the actual position of the bellows 6', 6".

The dual acting pressure boosting dual acting pressure boosting liquid partition device 2 is for example controllable by a variable flow supply from e.g. hydraulic pump unit 11 through the first inlet/outlet port 24' and second inlet/outlet port 24"The protruding portion 30 comprising a first end (i.e. via first piston area 30') in fluid communication with the first inlet/outlet port 24' and a second end (i.e. via first piston area 30") in fluid communication with the second inlet/outlet port 24". The rod 19 further defines a second piston area 31', 31" smaller than the first piston area 30', 30". The rod 19 separating the first and second plunger chambers 17', 17" and is operated to vary volumes of the first and second plunger chambers 17', 17" by extracting and retracting the rod 19 in/out of the first and second plunger chambers 17', 17", respectively. The rod 19 is a partly hollow and comprises a first recess 40' and a second recess 40". The first and second recesses 40', 40" are separated from each other. Thus, fluid is permitted from flowing between the first and second recesses 40', 40". The first recess 40' is in fluid communication with the first plunger chamber 17' and the second recess 40" is in fluid communication with the second plunger chamber 17'.

The dual acting pressure boosting liquid partition device's 2 function is to ensure that a fixed volume of hydraulic fluid, e.g. oil, is charging/dis-charging the bellows 6', 6". At the same time, it functions as a pressure amplifier (booster or intensifier). In the illustrated dual acting pressure boosting liquid partition device 2 the pressure is increased by having a larger first piston area 30', 30", than the second piston area 31' in the first plunger chamber 17' and second piston area 31" in the second plunger chamber 17", respectively. There is a fixed ratio between the first piston area 30', 30" and the second piston area 31', 31", depending on the difference in the first and second piston areas. Hence, a fixed pressure into the first or second outer chamber 44', 44" gives a fixed pressure amplified by the pressure difference of the first and second piston areas. However, the input pressure may be varied to get a different pressure out, but the ratio is fixed. The amplification of the pressure is vital to enable pumping of fluids well over the maximum normal pressure range of the industrial hydraulic pump units 11 that is powering the unit and is varied to best suited industry needs for pressures.

The dual acting pressure boosting liquid partition device 2 may comprise dual acting pressure boosting liquid partition device position sensor 21 which continuously communicates with the overall control system 100 which can operate the oil management system valve 16', 16" to refill or drain hydraulic fluid from the closed hydraulic loop volume based on input from the dual acting pressure boosting liquid partition device position sensor 21 in the dual acting pressure boosting liquid partition device 2 and in the bellows position sensor 12', 12". In the Figures, the dual acting pressure boosting liquid partition device position sensor 21 is arranged between the rod 19 and inner walls of the first or second plunger chamber 17', 17", such that the dual acting pressure boosting liquid partition device position sensor 21 is able to continuous monitor the position of the rod 19 and transmit signals to a control system comparing the position of the bellows 6', 6" and the piston or rod 19 in the dual acting pressure boosting liquid partition device 2. However, it is possible to arrange the dual acting pressure boosting liquid partition device position sensor 21 at other locations as well, including outside the dual acting pressure boosting liquid partition device 2, as long as it can monitor the position of the rod 19. As such, any leakage or overfilling of hydraulic fluid in any of the first or second plunger chambers 17', 17" can be detected and corrected (e.g. by using the oil management system valve 16', 16" to reset the rod to zero deviation position according to bellows position as described above).

Specifically, the first and second plunger chambers 17', 17' will be subjected to extreme pressures. All transitions are shaped to avoid stress concentrations. The rod 19 in the dual acting pressure boosting liquid partition device is preferably a hollow rod in order to compensate for ballooning of the shell (shell=the outer walls of the dual acting pressure boosting liquid partition device 2) during a pressure cycle. Preferably, the ballooning of the hollow rod is marginally less than the ballooning of shell to prevent any extrusion-gap between the hollow rod and the shell to exceed allowable limits. If this gap is too large, there will be leakage over the first and second seals 22', 22", resulting in uneven volumes of hydraulic fluids in the first and second plunger chambers 17', 17". The thickness of the shell and the walls of the hollow rod, i.e. the walls surrounding the first and second recesses 40', 40" are chosen such that they deform similarly/equally in the radial direction, and the first and second seals 22', 22" are also protected ensuring a long service life of the first and second seals 22', 22".

The control system has three main functions. The first main function of the control system is controlling the output characteristics of the pressure transfer device 1', 1": the pressure transfer device 1', 1" is able to deliver flow based on of a number of parameters like: flow, pressure, horsepower or combinations of these. Furthermore, if two dual acting pressure boosting liquid partition devices 2 are used, the pressure transfer device 1', 1" can deliver a pulsation free flow up to 50% of maximum theoretical rate by overlapping the two dual acting pressure boosting liquid partition devices 2 in a manner that one is taking over (ramping up to double speed) when the other is reaching its turning position. Thus, it achieved reduced flow rates at high pressures and high flow rates at reduced pressures, in all embodiments with a substantially laminar flow. This is achieved by having an over capacity on the hydraulic pump unit 11. As the rate increases there will be gradually less room for overlapping and thereby an increasing amount of pulsations. The variable displacement hydraulic pump unit 11 in combination with pressure sensors and bellows position sensor 12', 12" and dual acting pressure boosting liquid partition device position sensor 21 is key for the flexibility that the system offers. The control system, which may be computer based, also enables the possibility of multiple parallel pumping systems acting as one by tying them together with a field bus. This may be done by arranging the pumping systems in parallel and use the control system to force or operate the individual pumping systems asynchronous. This minimize the risk of snaking due to interference.

The second main function of the control system is to provide complete control of the bellows 6', 6" movement through the cycles in relation to the dual acting pressure boosting liquid partition device 2. This is of relevance in the closing/seating of the valves in the flow regulating assembly 13 (e.g. supply port 35', 35", pump port 36', 36", discharge port 37', 37", supply valve 38', 38", discharge valve 39', 39") because there is a combination of factors, which needs to work in synchronicity in order for this system to function with these extreme pressures and delivery rates. As for a spring, it is important for the bellows 6', 6" to operate within its design parameters, i.e. not over extending or over compressing in order to have a long service life.

The third main function of the control system is the oil management system valve 16', 16" of the control system which acts when the control system finds a difference between the positions of the dual acting pressure boosting liquid partition device 2 and the bellows 6', 6" or that the temperature is out of predefined limits. The dual acting pressure boosting liquid partition device 2 has in general the same strengths and flaws as a hydraulic cylinder, it is robust and accurate, but it has a degree of internal leakage over the first and second seals 22', 22" that over time will accumulate either as an adding or retracting factor in the closed hydraulic loop volume between the first and second plunger chambers 17', 17" and the inner volume 7', 7" of the bellows 6', 6". To address these issues both the bellows 6', 6" and the dual acting pressure boosting liquid partition device 2 are fitted with position sensors 12', 12", 21 that continuously monitors the position of these units to assure that they are synchronized according to software-programmed philosophy. Over time, the internal leakage of the system will add up, and when the deviation of the position between the bellows 6', 6" and the dual acting pressure boosting liquid partition device 2 reaches the maximum allowed limit, the first and/or second oil management system valves 16', 16" will add or retract the necessary volume to re-synchronize the system (and adjusting preferably automatically in relation to a known position of the bellows 6', 6"). In addition, there may be an issue that the liquid in the closed hydraulic loop volume between the pressure transfer device 1', 1" and the dual acting pressure boosting liquid partition device 2 generates heat through friction by flowing back and forth. On top of that the first and second seals 22', 22" in the dual acting pressure boosting liquid partition device 2 will also produce heat that will dissipate in to the liquid (e.g. oil) in the closed hydraulic loop volume. This issue may be addressed by using the same system as for compensating for internal leakage. The closed loop hydraulic volume can be replaced by the oil management system valve 16', 16". The control system detecting a leak in the hydraulic loop system and thus operates the first and/or second oil management system valve 16', 16" to enable a replacement of the closed hydraulic loop volume by isolating the bellows 6', 6" in a compressed, retracted, position and allowing the dual acting pressure boosting liquid partition device 2 to discharge its volume in to the reservoir (external) and re-charging it with cool oil from the cooling system. For the valves in the flow regulating system 13 (e.g. supply port 35', 35", pump port 36', 36", discharge port 37', 37", supply valve 38', 38", discharge valve 39', 39") to have a long service life it is desirable that the seating of the valves or ports 35', 35", 36', 36", 37', 37", 38', 38" is gentle or soft, i.e. that the valve members are not smashed into their desired valve seats. To achieve this the system monitors the position of the dual acting pressure boosting liquid partition device 2 (i.e. the piston in the dual acting pressure boosting liquid partition device), and when approaching end position, the discharge speed of the hydraulic pump unit 11 is ramped down to cushion the valve before seating to prevent forging of the check valve seat.

In the preceding description, various aspects of the method, apparatus and use of the invention have been described with reference to illustrative embodiments. For purposes of explanation, systems and configurations were set forth in order to provide a thorough understanding of the system and its workings. However, this description is not intended to be construed in a limiting sense. Various modifications and variations of the illustrative embodiments, as well as other embodiments of the system, which are apparent to persons skilled in the art to which the disclosed subject matter pertains, are deemed to lie within the scope of the present invention.

| Reference list: | |
|---|---|
| 1', 1" | Pressure transfer device |
| 2 | Dual acting pressure boosting liquid partition device |
| 3 | Connection port |
| 4', 4" | Pressure cavity |
| 5' | First port |
| 6 | bellows |
| 7 | Inner volume of bellows |
| 8 | gap |
| 9', 9" | Guide |
| 10', 10" | magnet |
| 11 | Hydraulic pump unit |
| 12', 12" | Bellows Position Sensor |
| 13 | Flow regulating assembly |
| 14 | Inlet manifold |
| 15 | Outlet manifold |
| 16' | First oil management system valve |
| 16" | Second oil management system valve |
| 17' | First plunger chamber |
| 17" | Second plunger chamber |
| 18' | First plunger port |
| 18" | Second plunger port |
| 19 | Rod |
| 20 | Hollow cylinder housing |
| 21 | Dual acting pressure boosting liquid partition device position sensor |
| 22' | First seal |
| 22' | Second seal |
| 23 | Lubrication system |
| 24' | First inlet/outlet port |
| 24" | Second inlet/outlet port |
| 25' | First actuator |
| 25" | Second actuator |
| 26' | First valve port |
| 26" | First valve port |
| 27' | Second valve port |
| 27" | Second valve port |
| 28' | Third valve port |
| 28" | Third valve port |
| 29' | Oil reservoir |
| 29" | Oil reservoir |
| 30' | First piston area |
| 30" | First piston area |
| 31' | second piston area |
| 31" | Second piston area |
| 35' | Supply port |
| 35" | Supply port |
| 36' | Pump port |
| 36" | Pump port |
| 37' | Discharge port |
| 37" | Discharge port |
| 38' | Supply valve |
| 38" | Supply valve |
| 39' | Discharge valve |
| 39" | Discharge valve |
| 40' | First recess |
| 40" | Second recess |
| 42, 42" | Temperature sensor |
| 43' | inductive rod |
| 43" | inductive rod |
| 44' | First outer chamber |
| 100 | Control System |

The invention claimed is:

1. A method of controlling working range of a pump bellows, the method comprising the steps of:

a) reading at least a first position of a bellows in a closed hydraulic loop volume using at least one position sensor, b) transmitting a first position signal representing the first position to a control system, c) wherein the control system, based on the at least first position signal:

c1) determines the position of the bellows represented by the at least first position signal, c2) compares the position of the bellows with a predetermined bellows position operating range, and c3) if the position is outside the predetermined bellows position operating range, instructs an oil management system valve allowing a dual acting pressure boosting liquid partition device to recalibrate the hydraulic fluid volume in the closed hydraulic loop volume to re-establish a hydraulic fluid volume that causes the bellows to return to a position within the predetermined bellows position operating range, and wherein, if the position is below the predetermined bellows position operating range, the control system instructs the oil management system valve allowing the dual acting pressure boosting liquid partition device to recalibrate to fill hydraulic fluid into the closed hydraulic loop volume, and if the position is above the predetermined bellows position operating range, the control system instructs the oil management system valve allowing the dual acting pressure boosting liquid partition device to recalibrate to drain hydraulic fluid from the closed hydraulic loop volume.

2. The method according to claim 1, wherein the first position signal from the at least one position sensor represents the position of the bellows movably arranged within a pressure cavity.

3. The method according to claim 2, wherein a second signal from at least one second position sensor represents the position of a plunger in a the dual acting pressure boosting liquid partition device.

4. The method according to claim 3, wherein the control system compares the at least first position signal and the second signal and determines a relative synchronization between the bellows and the plunger and, compares the relative synchronization with a predetermined relative synchronization range, and, if the relative synchronization is outside the predetermined relative synchronization range, instructs an oil management system valve allowing a dual acting pressure boosting liquid partition device to recalibrate the hydraulic fluid volume in the closed hydraulic loop volume to re-establish a hydraulic fluid volume that causes the relative synchronization to return to within the predetermined relative synchronization range.

5. The method according to claim 1, further comprising:

d) before step c), reading a first temperature from one or more temperature sensors arranged at different locations in the closed hydraulic loop volume, e) transmitting a first temperature signal representing the first temperature to the control system, f) wherein the control system, based on the first temperature signal, determines the temperature in the closed hydraulic loop volume, compares the temperature with a predetermined temperature operating range, and based on whether the position, the difference in position or the temperature is within, above or below the predetermined bellows position operating range, the predetermined position difference range or predetermined temperature operating range, respectively, operates the oil management system valve allowing the dual acting pressure boosting liquid partition device to recalibrate by:

staying idle, filling hydraulic fluid into, or draining hydraulic from the closed hydraulic loop volume.

6. The method according to claim 1, wherein the bellows has a center axis and the bellows extends and retracts in a substantially longitudinal direction along the center axis, and wherein one of the position sensors is a bellows position sensor reading the axial extension of the bellows.

7. The method according to claim 1, wherein the oil management system valve is arranged between the dual acting pressure boosting liquid partition device and a pressure transfer device and comprises a valve arrangement, wherein the valve arrangement, based on input from the control system, is operated to:

open for fluid communication between the dual acting pressure boosting liquid partition device and an inner volume of the bellows, open for fluid communication between a fluid reservoir and the closed hydraulic loop volume for filling of hydraulic fluid into the closed hydraulic loop volume, open for fluid communication between a fluid reservoir and the closed hydraulic loop volume for draining hydraulic fluid from the closed hydraulic loop volume.

8. A system comprising a control system communicating with an oil management system valve, the system comprises:

a pressure transfer device comprising:

a pressure chamber housing, the pressure chamber housing comprises:

a pressure cavity and a bellows movably arranged within the pressure cavity, at least one position sensor configured to read the position of the bellows in a closed hydraulic loop volume and transmit a first position signal representing the first position to the control system, and wherein the control system, based on the at least first position signal is configured to:

determine the position of the bellows represented by the at least first position signal, compare the position of the bellows with a predetermined bellows position operating range, and based on whether the position is outside the predetermined bellows position operating range, is configured to operate the oil management system valve allowing a dual acting pressure boosting liquid partition device to recalibrate the hydraulic fluid volume in the closed hydraulic loop volume to re-establish a hydraulic fluid volume that causes the at least first position to return to a position within the predetermined bellows position operating range, wherein if the position is within, above or below the predetermined bellows position operating range, respectively, operate the oil management system valve allowing the dual acting pressure boosting liquid partition device to recalibrate by:

staying idle, filling hydraulic fluid into, or draining hydraulic fluid from the closed hydraulic loop system.

9. The system according to claim 8, wherein the first position signal from the at least one position sensor represents the position of the bellows.

10. The Ssystem according to claim 9, wherein a second signal from at least one second position sensor represents the position of a plunger in the dual acting pressure boosting liquid partition device.

11. The system according to claim 10, wherein the control system is configured to:

compare the at least first position signal and the second signal and determine a difference in position between the bellows and the plunger and, compare the difference in position with a predetermined position difference range, and if the difference in position is outside the predetermined position difference range, instruct the oil management system valve allowing the dual acting pressure boosting liquid partition device to recalibrate the hydraulic fluid volume in the closed hydraulic loop volume to re-establish a hydraulic fluid volume that causes the position difference to return to within the predetermined position difference range.

12. The system according to claims 8-11, further comprising one or more temperature sensors configured to read temperature in the closed hydraulic loop volume and transmit signals to the control system, and wherein the control system is configured to:

based on whether the difference in position or the temperature is within, above or below the predetermined bellows position operating range, the predetermined position difference range or predetermined temperature operating range, respectively, operate the oil management system valve allowing the dual acting pressure boosting liquid partition device to recalibrate by:

staying idle, filling hydraulic fluid into, or draining hydraulic fluid from the closed hydraulic loop volume.

* * * * *